United States Patent [19]

Seleznev et al.

[11] 3,973,872

[45] Aug. 10, 1976

[54] CENTRIFUGAL COMPRESSOR

[76] Inventors: Konstantin Pavlovich Seleznev, ulitsa Politekhnicheskaya, 29, kv. 91; Jury Borisovich Galerkin, ulitsa Vavilovykh, 11, korpus 3, kv. 125; Leonid Yakovlevich Strizhak, ulitsa Vavilovykh, 11, korpus 3, kv. 128; Anatoly Vasilievich Zuev, ulitsa Galstyana, 38, kv. 94, all of Leningrad, U.S.S.R.

[22] Filed: Aug. 1, 1975

[21] Appl. No.: 600,972

[52] U.S. Cl. ..... 415/211; 415/213 R; 415/207

[51] Int. Cl.[2] ..... F04D 29/44

[58] Field of Search ..... 415/211, 213, 207; 416/186

[56] References Cited

UNITED STATES PATENTS

| | | | |
|---|---|---|---|
| 1,047,663 | 12/1912 | Lawaczeck | 415/211 |
| 1,633,609 | 6/1927 | Schmidt | 415/213 R |

FOREIGN PATENTS OR APPLICATIONS

| | | | |
|---|---|---|---|
| 411,749 | 1909 | France | 415/213 R |
| 475,781 | 3/1915 | France | 415/211 |
| 182,804 | 4/1907 | Germany | 415/211 |

*Primary Examiner*—Henry F. Raduazo
*Attorney, Agent, or Firm*—Haseltine, Lake & Waters

[57] ABSTRACT

The compressor comprises an impeller and a diffuser with blades (vanes) of a constant thickness, arranged around the circumference of the impeller and diffuser. In the zone between the entrance edge of each blade (vane) and its center in a radial direction the angle between the pitch line in the longitudinal section of each blade (vane) and the tangent line to an imaginary circle drawn through any point of said pitch line from the center of the impeller axis of rotation is equal to the entrance angle of the blades (vanes). In the remaining zone of the blade (vane) this angle varies according to a quadratic parabola.

Each pair of adjacent blades has blades of a different length, the exit edges of the blades being located on one imaginary circle drawn from the center of impeller axis of rotation while the entrance edges of these blades lie on two imaginary circles drawn from the same center.

4 Claims, 8 Drawing Figures

CENTRIFUGAL COMPRESSOR

The present invention relates to radial-flow turbines and more particularly it relates to centrifugal compressors.

The present invention will be employed to the best advantage in making impellers and diffusers of compressors, air blowers, fans and pumps.

A centrifugal compressor is used to compress gases and carry them to the point of utilization, such as blast furnaces, gas receivers and various apparatuses working on compressed air, etc.

A centrifugal compressor comprises an intake, impellers, diffusers located after the impellers, back flow guide apparatuses or back flow channels and volutes or collectors.

Each stage of a centrifugal compressor comprises an impeller rotating in a casing, a diffuser, a back flow guide apparatus or a back flow channel and a volute a collector. The gas flows to the impeller from the intake or a back flow apparatus of a previous stage.

Passing radially through the impeller, the gas is acted upon by the blades, its pressure rises while its velocity approaches the peripheral rotation speed of the blades. When the gas enters the diffuser, its velocity drops with a corresponding increase in pressure. The air pressure in one stage of a centrifugal compressor can be raised 2–4 times. Therefore, the compressors are made of a multiple-stage type when high pressures have to be obtained.

The diffuser may be either of the vaned or vaneless type.

Vaneless diffusers are made use of to suit users' requirements for high versatility. The efficiency of the vaneless diffuser is but little affected by variation of the operating conditions which is very important when, as it often happens the centrifugal compressor operates' under other operating conditions than estimated. The centrifugal compressor with vaned diffuser features higher efficiency under operating conditions or approximating them through lower versatility.

The vaned diffuser provides for reduction of compressor dimensions however, featuring more complicated structure than vaneless diffuser.

Both the impeller and the vaned diffuser are made in the form of two discs with blades or vanes equispaced between them around the circumference. The impeller is installed concentrically inside the vaned diffuser. All the blades or vanes make up blading assembly. The blades have entrance edges located at the side where the flow of gas enters the blade channel and exit edges at the side where the flow of gas leaves said blade channel.

As the impeller rotates, there arises an interaction of forces between the blades and the flow of gas moving through the blade channels; as a result, a kinetic energy is imparted to the gas flow, accompanied by an increase in the gas pressure and temperature. Leaving the impeller blade channels the flow of gas enters the channels of a fixed vaned diffuser. Here part of the kinetic energy of the gas flow is transformed into an energy of pressure. Then the compressed gas is accumulated in the volute (collector) and directed through a corresponding pipe connection to the point of utilization.

Widely known in the art are impellers and diffusers with blades and vanes whose pitch line in their longitudinal section lies on the arc of an imaginary circle. The radius of this imaginary circle as well as the position of its center relative to the center of the impeller rotation axis depend on the entrance and exit angle of the blade vane and on the radiuses of the imaginary circles, drawn from the center of the impeller rotation axis and passing through the entrance and exit edges of the blade. The entrance and exit angles of a blade should be understood as the angles included between the blade pitch line and the tangent lines to the imaginary circles drawn from the center of the impeller rotation axis and passing through the entrance and exit edges of the blade. The impellers and vaned diffusers of this type are characterized by a sufficiently high efficiency at the flow velocities in the blade channels corresponding to small and medium Mach numbers which is characteristic of the stages of centrifugal compressors working at small and medium coefficients of head and rates of gas flow and at peripheral speeds up to 200–250 m/s on the outside diameter of the impeller. The Mach number denotes the degree of approximation of the gas flow velocity to the speed of sound and is determined as a ratio of the flow velocity to the value of $\sqrt{KRT}$ where:

$K$ = adiabatic compression factor for the given gas;

$R$ = gas constant;

$T$ = temperature of gas in the considered point.

As the peripheral speed of the impeller increases, the flow velocity on certain parts of the blade surface reaches a supersonic speed (the Mach number exceeding a unity) which brings about the so-called shock waves (an instantaneous change of gas pressure and density) and separation of flow from the blade surface. These phenomena increase considerably the energy losses in the blade channels and reduce the compressor efficiency. The disadvantages of the known impellers and vaned diffusers limit the pressure rise in a single stage and reduction of the number of compressor stages which constitutes an important problem in the modern power engineering.

To counter these disadvantages, there have been attempts to evolve impellers whose blades are curved so as to ensure a preset change in the velocity of the working fluid (distribution of velocities) inside the blade channels. For example, there exist impellers whose blades have a shape ensuring a gradual decrease in the average relative velocity of the flow throughout the length of the blade channel. Other impellers have blades shaped so as to change the velocity of the flow along the blade surfaces in accordance with the preset change in the pressure difference on the blade sides along the blade channel or along a normal line to the pitch line of the blade channel in the meriodional plane. However, the design of these impellers cannot account for all the sources of energy losses, such as the effect of the velocity level on the blade surfaces and the optimum values of certain determining geometric parameters, in particular, the density of blading. Therefore, there are no experimental data which would confirm the advantages of such impellers over the conventional impellers whose blades are described by the arc of an imaginary circle.

The axial impellers are known to have the blades of a shape ensuring a constant relative velocity along the back surface of the blades (i.e., the surface directed contrary to the sense of impeller rotation) with account taken of the other parameters of the blade channel. However, this problem has not been solved for the impellers and vaned diffusers of radial centrifugal compressors.

Known in the previous art are impellers and vaned diffusers wherein the pitch lines of the blades lie on the arc of an imaginary circle drawn from the center located on the impeller rotation axis, each two adjacent blades being of a different length. The exit edges of the blades lie on an imaginary circle drawn from the center of the impeller rotation axis while the entrance edges of the shorter blades lie on the imaginary circle which is drawn from the same center and has a diameter larger than that of the imaginary circle on which the entrance edges of the other blades are located. Such an arrangement widens the working zone of the characteristic of the centrifugal compressor stage. The optimum diameter of the imaginary circle drawn from the center of the impeller rotation axis and passing through the entrance edges of the shorter blades has been found experimentally only for a few type-sizes of the impellers and diffusers with blades of the abovementioned shape. The optimum degree of reduction in the length of each blade of the impeller and diffuser with the blades of another shape is unknown.

An object of the present invention is to raise the efficiency of a centrifugal compressor.

Another object of the present invention is to extend the working zone of the characteristic of a centrifugal governor.

These objects are accomplished by providing a centrifugal compressor with a diffuser and an impeller whose channels are formed by constant-thickness blades equispaced around the impeller circumference with a ratio of the blade length along the blade pitch line to the mean arithmetical width of the blade channel being equal to 3.8 – 5.6 wherein, according to the invention, the blades are shaped in such a manner that in the zone between the entrance edge of the blade and its middle in the radial direction the angle between the pitch line in the longitudinal section of each blade and the tangent line to the imaginary circle drawn through any point of said pitch line from the center of the impeller rotation axis is equal to the entrance angle of the blades while on the remaining zone of the blade this angle varies according to a quadratic parabola described by the formula $$\frac{\beta_x-\beta_1}{\beta_2-\beta_1} = A + B\left(\frac{\tau_x-\tau_1}{\tau_2-\tau_1}\right) + C\left(\frac{\tau_x-\tau_1}{\tau_2-\tau_1}\right)^2$$

where: $\beta_x$ = angle between the blade pitch line and the line tangent to an imaginary circle drawn through any point of said pitch line from the center of the impeller rotation axis;

$\beta_1$ = blade entrance angle;

$\beta_2$ = blade exit angle;

$\tau_x$; $\tau_1$; $\tau_2$ = radiuses of the imaginary circles drawn from the center of the impeller rotation axis, located on which are, correspondingly, any point of the blade pitch line, entrance and exit edges of the impeller blades;

$A$; $B$; $C$ = coefficients of the parabola determined by the boundary conditions: values of $\beta_x$ at the beginning and end of the parabola and the absence of a break at the junction between the parabolic and initial zones of the blade.

In such a shape of the blades the relative velocity of the working fluid flow over the back side of the blades either stays constant or increases smoothly in the direction from the entrance of the blade channel to its exit while the Mach number in any point on the back side of the blades is not higher than the Mach number on this surface at the entrance into the blade channel.

It is an established fact that a type of change in the relative velocity along the back side of the blade exerts an effect of possible separation of flow from the surface of the blade and on the churning losses involved in said separation of flow. Keeping the relative velocity along the back side of the blade at a constant level or increasing it gradually when the Mach number at any point on said surface does not exceed the Mach number on the same surface at the entrance into the blade channel reduces the churning losses. Such a change in the relative velocity of the working fluid flow along the back side of the blade at the above-mentioned ratio of its length along its pitch line to the mean arithmetical width of the blade channel ensures also an optimum interrelation of all types of losses and reduces the summary losses in the blade channel thereby stepping up the efficiency of a centrifugal compressor. The present invention ensures a particularly substantial increase in the efficiency of a centrifugal compressor with large Mach numbers in the blade channels.

In one of the embodiments of the invention each two adjacent impeller blades and diffuser vanes have a different length the exit edges of the blades and vanes lying on one imaginary circle described from the center of the impeller rotation axis while the diameter of the imaginary circle which is drawn from the center of the impeller rotation axis and on which the entrance edges of the shorter blades are located amounts to 1.2–1.3 of the diameter of an imaginary circle drawn from the same center and joining the entrance edges of the other blades.

An increase in the entrance area through the blade channel reduces the velocity of the gas flow at the channel entrance which widens the working zone of the characteristic of the centrifugal compressor while in certain types of impellers this ensures an additional increase in the efficiency of the centrifugal compressor.

Now the invention will be described in detail by way of example with reference to the accompanying drawings, in which.

Figure 2:
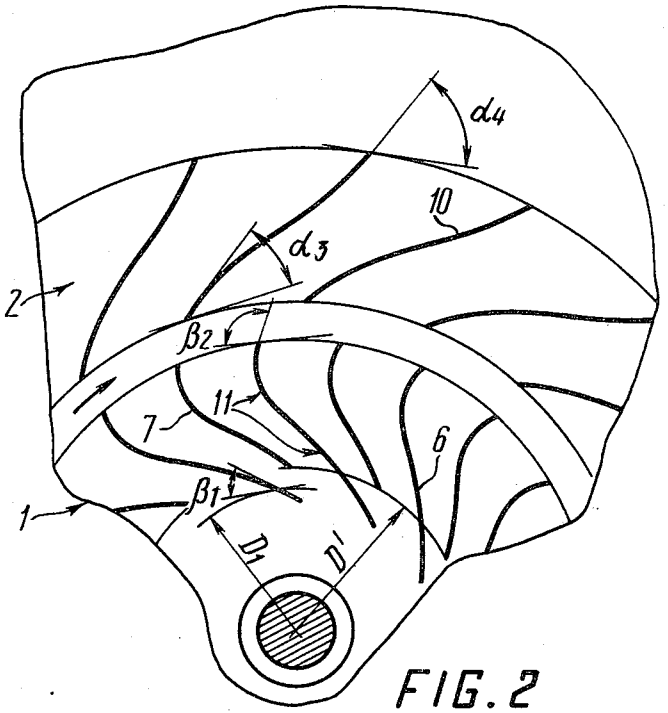
FIG. 2 shows a stage of the centrifugal compressor in a radial plane.
Figure 1:
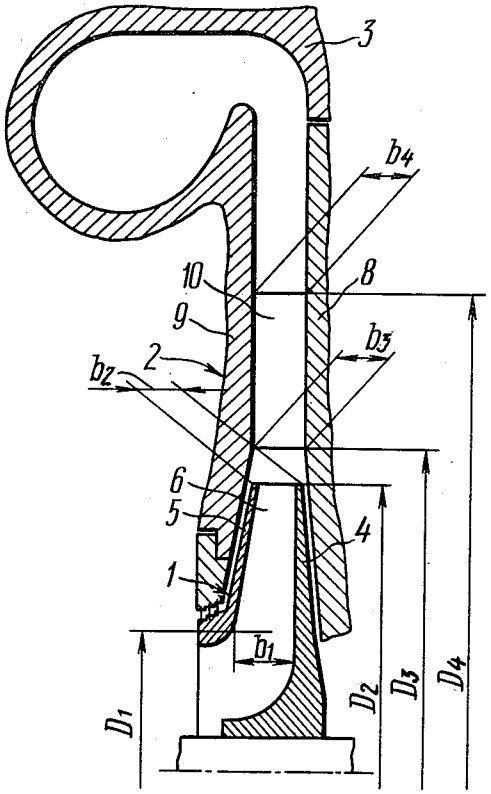
FIG. 1 shows a stage of the centrifugal compressor according to the invention in a meridional plane.

The stage of a radial centrifugal compressor illustrated in FIGS. 1, 2 comprises an impeller 1 installed concentrically with a vaned diffuser 2, and a volute 3.

The impeller 1 is made up of two discs 4, 5 with blades 6, 7 equispaced between them around the circumference of the impeller 1. The alternating blades 6, 7 differ in length from each other.

The vaned diffuser 2 is similarly made up of two discs 8, 9 with vanes 10 installed between them, being equispaced around the circumference of the diffuser 2.

The impeller 1 and the vaned diffuser 2 may be made of any hard material suitable for operation under the preset conditions in a given working fluid. The blades 6, 7 and vanes 10 can be made integral with their limiting discs 4, 5, 8, 9 by milling, casting, burning, etc. or can be secured to said discs 4, 5, 8, 9 by screws, rivers, by welding, brazing, etc.

The blades 6, 7 of the impeller 1 and the vanes 10 of the diffuser 2 may be of the same or different length depending on the actual geometrical dimensions of the impeller and diffuser and on the parameters of the working fluid flowing through them.

The shape of the blade 6, 7 is calculated on the basis of the geometrical angle $\beta$ between the pitch line of the blade 6, 7 and the tangent to an imaginary circle drawn from the center of the rotation axis of the impeller 1 and passing through any point of this pitch line at a given rate of gas flow G at the entrance into the impeller 1, coefficient of theoretical fluid head $\psi_2 = Cu_2/U_2$, geometrical dimensions of the impeller and angular velocity $\omega$ of the impeller 1, in accordance with the following system of equations:

$$\frac{z}{2\bar{G}}\int_{r_1}^{r_x} \gamma(W_3^2 - W_4^2)b.r.dr = r_x \left(\omega r_x - \frac{Cr_x}{tg\beta_x}\right) ;$$

$$Cr_x = \frac{\bar{G}}{2\gamma_x \pi r_x b_x \left(1 - \left(\frac{z\delta}{2\pi r_x \sin\beta_x}\right)\right)} ;$$

$$\frac{\gamma_x}{\gamma_1} = \left\{1 + \frac{\frac{K-1}{2}Mu^2 \left\{\left[\left(\frac{r_x}{r_2}\right)^2 - \left(\frac{r_1}{r_2}\right)^2\right] + \left[\left(\frac{W_1}{W_2}\right)^2 - \left(\frac{W_x}{W_2}\right)^2\right]\right\}}{1 - \frac{K-1}{2}Mu^2 \left(\frac{C_1}{u_2}\right)^2}\right\}^{\left(\eta_1 \frac{K}{K-1} - 1\right)}$$

where:

$\bar{G}$ = mass flow of gas through the impeller;

$Cu_2$ = peripheral component of the absolute velocity $U_2$ of the gas flow at the impeller exit;

z = number of impeller blades;

$\gamma$ = specific weight of gas;

$b$ = width of blade;

$r$ = radiuses of the imaginary circles drawn from the center of rotation axis of the impeller 1;

$Cr_x$ = radial component of the absolute velocity of gas flow in the reference point;

$\gamma_x$ = specific weight of gas in the reference point;

$b_x$ = blade width in the reference point;

$r_x$ = radius of the imaginary circle drawn from the center of the impeller rotation axis through the reference point;

$\delta$ = thickness of the blade in a cross section along its length;

$\gamma_1$ = specific weight of gas at the entrance into the blade channel;

$$Mu = \frac{U_2}{\sqrt{KRT_o}} = \text{Mach number} ;$$

$W_x$ = average relative velocity of the gas flow through the blade channel in the reference point;

$\eta_1$ = polytropic efficiency of the impeller;

$$\eta_1 = \frac{\frac{n}{n-1}}{\frac{K}{K-1}}$$

$n$ = stands for polytropic compression process in the impeller $C_1$ = absolute velocity of the gas flow at the entrance into the blade channel.

Such a blade 6 with a constant thickness $\delta$ has an angle $\beta$ between its pitch line and the tangent line to the imaginary circle drawn from the center of the rotation axis of the impeller 1 through any point on this pitch line, said angle being equal to the entrance angle $\beta$, of the blade 6 in the zone from the entrance edge to the middle of the blade 6 in a radial direction, while in the remaining zone this angle $\beta$ varies according to a quadratic parabola:

$$\frac{\beta_x - \beta_1}{\beta_2 - \beta_1} = A + B\left(\frac{\tau_x - \tau_1}{\tau_2 - \tau_1}\right) + C\left(\frac{\tau_x - \tau_1}{\tau_2 - \tau_1}\right)^2 ;$$

where: $A, B, C$ = coefficients of the parabola determined by the boundary conditions, i.e., the values of $\beta_x$ at the beginning and end of the parabola and the absence of a break at the junction between the parabolic and initial zones of the blade.

The number z of the blades 6, 7 is found from the assumption that the relation of the blade length along its pitch line to the mean arithmetical width of the blade channel $$\bar{a} = \frac{\pi\bar{D}}{z}$$

Sin $\beta - \delta$ ranges from 3.8 to 5.6. Here $$\bar{D} = \frac{D_1 + D_2}{2},$$

$$\bar{\beta} = \frac{\beta_1 + \beta_2}{2}$$

$D_1$, $D_2$ are the diameters of the imaginary circles drawn from the center of the axis of rotation of the impeller 1, these circles joining the entrance and exit edges of the blades 6, 7. Generally, the imaginary circle with the diameter $D_1$ passes through the central line of the blade channel in a meridial plane.

Figure 3:
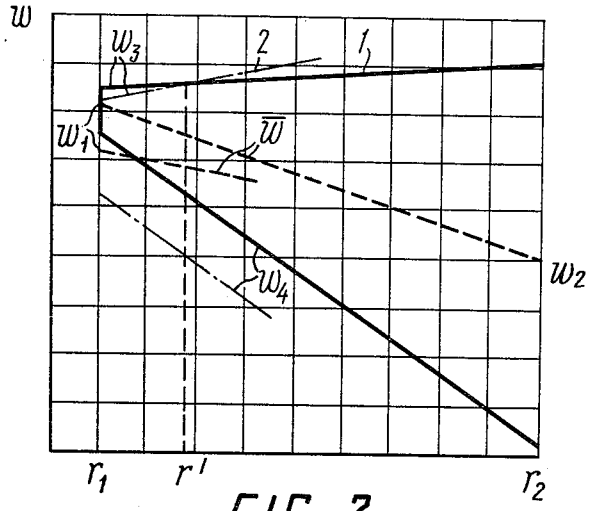
FIG. 3 is a chart showing the distribution of relative velocities of the working fluid flow on the blade surfaces throughout the length of the impeller blade channel (along the pitch line of the blade channel in a meridional plane)

With such a shape of the blades 6, 7 the relative velocity of the gas flow along the back side of the blade 6, 7 grows gradually while the Mach number on the back side on the blade 6, 7 is not higher than the Mach number on this surface at the entrance into the blade channel. The distribution of the relative velocity of the gas flow over the surface of the blade 6, 7 along the blade channel is illustrated in FIG. 3 where $W_1$ = mean relative velocity of the flow at the entrance into the blade channel, $W_2$ = mean relative velocity of the flow at the exit from the blade channel; $W_3$ = relative velocity of the flow over the back surface of the blade; $W_4$ = relative velocity of the flow on the front surface of the blade 6, 7 and $W$ = mean relative velocity of the flow in the blade channel.

the Mach number on the same surface at the entrance into the vane channel.

The Table 1 below gives the parameters of the manufactured and tested impellers 1. The outside diameter $D_2$ of all the impellers is equal in this case to 352 mm. The impeller blades in versions I, II, IV, VI have been made in accordance with the present invention. The impellers 1 in versions III, V, VII have conventional blades whose pitch lines pass along the arcs of imaginary circles.

In this Table:

Table 1

| | $\Phi_o$ | $\psi_2$ | $D_1/D_2$ | $\beta_1$ | $\beta_2$ | $Z$ | $\frac{l}{\bar{A}}$ | $\beta_x$ where $\frac{\tau_x-\tau_1}{\tau_2-\tau_1}=0,5$ | $D^1/D_1$ |
|---|---|---|---|---|---|---|---|---|---|
| I | 0.0865 | 0.745 | 0.585 | 40°07′ | 117°06′ | 28/14 | 4.0 | 41°06′ | 1.26 |
| II | 0.0775 | 0.706 | 0.585 | 36°31′ | 109°36′ | 26/13 | 4.07 | 36°45′ | 1.27 |
| III | 0.085 | 0.882 | 0.585 | 35° | 90° | 28/14 | 3.71 | 70°07′ | 1.13 |
| IV | 0.052 | 0.611 | 0.503 | 35° | 58°27′ | 16/8 | 4.81 | 29°55′ | 1.25 |
| V | 0.052 | 0.636 | 0.503 | 31° | 45° | 20 | 6.98 | 43°17′ | — |
| VI | 0.0285 | 0.655 | 0.464 | 31°17′ | 72°39′ | 16/8 | 4.95 | 28°14′ | 1.21 |
| VII | 0.026 | 0.650 | 0.487 | 29°06′ | 45° | 20 | 7.56 | 43°08 | — |

$\Phi_o = \frac{UV_o}{\pi D_2^2 U_2}$ = coefficient of flow rate;

$V_o$ = rate of gas flow determined by the gas parameters at the impeller entrance;

$D_2$ = outside diameter of the impeller (diameter of the imaginary circle drawn from the centre of the impeller axis of rotation and joining the exit edges of the blades);

$U_2$ = peripheral velocity on the outside diameter of the impeller;

$\psi = \frac{G_p(T_2-T_o}{U_2^2/g}$ = coefficient of internal head;

$G_p$ = mean specific heat capacity of gas at a constant pressure;

$T_2$ = full temperature of gas at the impeller exit;

$T_o$ = full temperature of gas at the impeller entrance;

The entrance edges of the shorter blades 7 lie on an imaginary circle drawn from the center of the axis of rotation of the impeller 1, with a radius $\gamma^1$ at which the curve representing the relative flow velocity distribution lengthwise the blade channel shows the intersecting lines of variations of the relative flow velocity on the back side of the blade 6, the line representing the blading assembly with a full number of the blades being a solid one, while that representing the blading assembly with a double-reduced number of the blades 6 is a dot-and-dash line. In experimental impellers the diameter $D' = 2\ r'$ of the imaginary circle drawn from the center of the impeller rotation axis and joining the entrance edges of the shorter blades 7 has been equal to 1.2 – 1.3 of the diameter of the imaginary circle drawn from the same center and joining the entrance edges of the blades 6.

Figure 4:
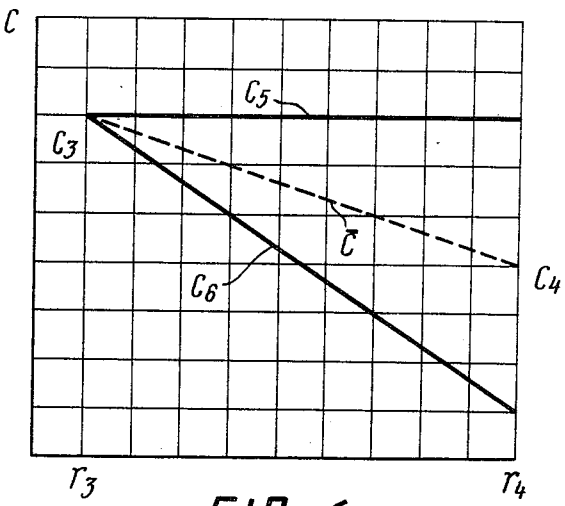
FIG. 4 is a chart showing the distribution of relative velocities of the working fluid flow on the vane surface throughout the length of the diffuser vane channel (along the pitch line of the vane channel in a meriodional plane)

The vaned diffuser 2 has vanes 10 whose shape is similar to that of the blades 6 and 7 of the impeller 1. This shape is outlined in such a manner that the velocity of the flow along the back side of the vane 10 of the diffuser 2 is constant and equal to the velocity of the flow at the entrance into the vane channel as shown in FIG. 4 where $C_3$ = velocity of the flow at the entrance into the vane channel of the diffuser 2; $C_4$ = velocity of the flow at the exit from the vane channel of the diffuser 2; $C_5$ = velocity of the flow over the back side of the vane 10 of the diffuser 2; $C_6$ = velocity of the flow over the front side of the vane 10 of the diffuser 2; $C$ = mean velocity in the vane channel of the diffuser 2; and $r_3$, $r_4$ = radiuses of the imaginary circles drawn from the center of the axis of rotation of the impeller 1 and joining, respectively, the entrance and exit edges of the vanes 10 of the diffuser 2. With such a shape of the vane 10 of the diffuser 2 the Mach number in any point on the back surface of the vane 10 is not higher than $g$ = free-fall acceleration;

$$\psi = \frac{\frac{k}{k-1} RT_1 \left[ \left( \frac{P}{P_o} \right)^{\frac{k-1}{k-1}} \right]}{U_2^2/g}$$

= coefficient of adiabatic head in a centrifugal compressor stage;

$P$ = full pressure of gas at the exit from the compressor stage (volute);

$P_0$ = full pressure of gas at the impeller entrance;

$$\eta = \frac{\frac{k}{k-1} RT_1 \left[ \left( \frac{P}{P_o} \right)^{\frac{k-1}{k-1}} \right]}{G_p(T_2-T_o)}$$

= adiabatic efficiency of a centrifugal compressor stage.

Referring to the Table 1 the fractional number z of the blades signifies that each other blade of the given impeller is shorter; D′ = diameter of the impeller 1 and joining the entrance edges of the shorter blades 7.

Figure 5:
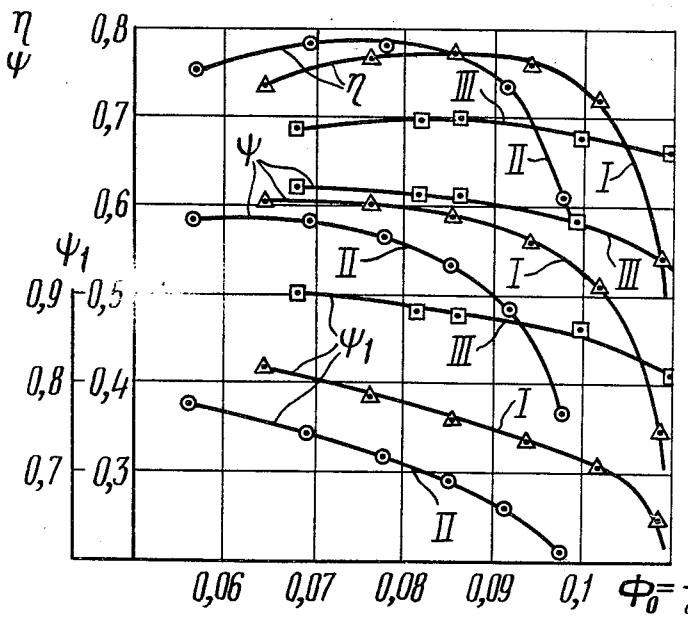
FIG. 5, 6, 7 are the working characteristics of the stages of a radial centrifugal compressor with vaneless diffusers.

The experimental characteristics of the stages of a radial centrifugal compressor with impellers made to versions I, II, III and venless diffusers at $M_u = 0.8$ are shown in FIG. 5 where numbers I, II, III denote the impeller versions indicated in Table I.

It can be seen from FIG. 5 that the impellers made in accordance with the present invention increase the efficiency of a centrifugal compressor stage by 5–6% approximately as compared with the known impellers used at the same parameters.

Figure 6:
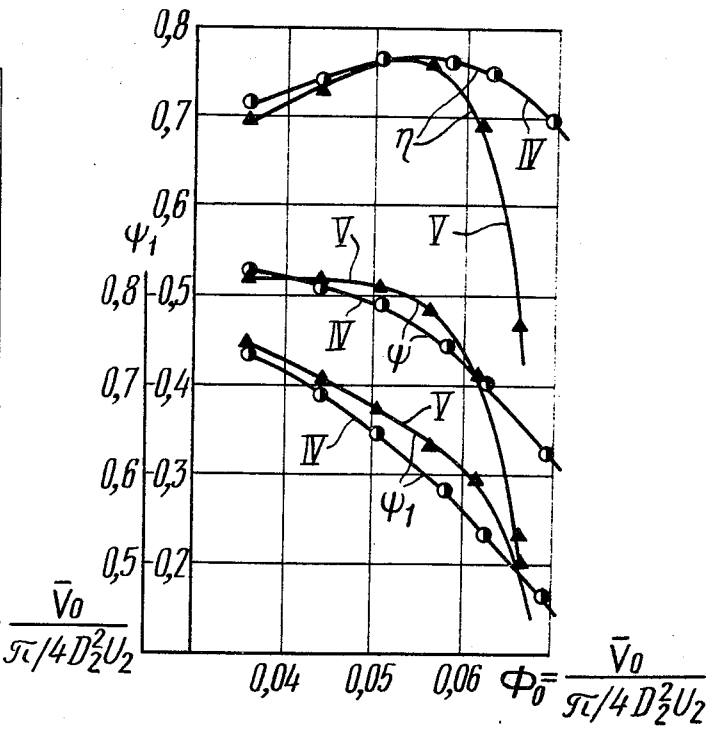
Figure 7:
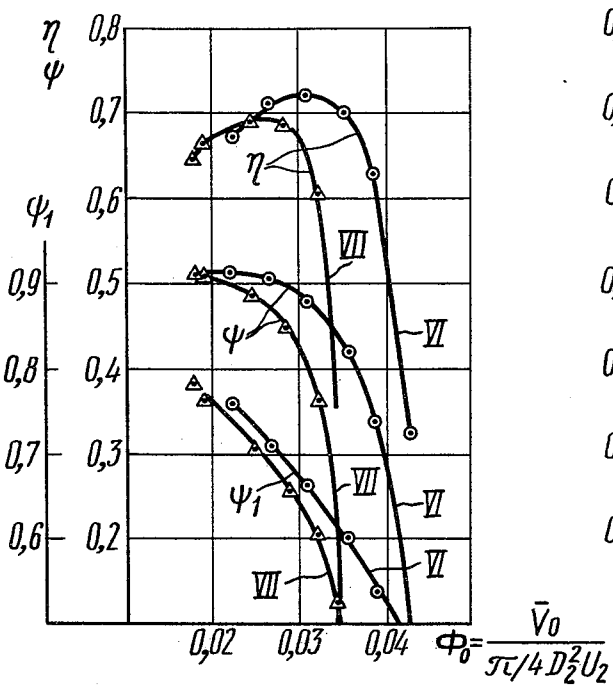

Shown in FIGS. 6 and 7 are the characteristics of the centrifugal compressor stages with the impellers according to versions IV, V, VI, VII and with vaneless diffusers at $M_u = 0.78$. The figures in the charts also correspond to the impeller versions in Table 1.

As shown in FIGS. 6 and 7 the impellers made in accordance with the present invention increase the efficiency of a centrifugal compressor stage at lower coefficients of the rate of flow of the working fluid by 2–3% approximately in comparison with the known impellers.

It can also be seen in FIGS. 6 and 7 that reducing the length of each other blade in the impellers according to versions IV and VI widens the working zone of the characteristic of the centrifugal compressor stage.

The Table 2 below characterizes the versions of manufactured and tested vaned diffusers. Version I in this Table represents the vaned diffuser made to the present invention while version II denotes the vaned diffuser whose pitch line of the vane is curved along the arc of an imaginary circle. Here $D_3$ and $D_4$ stand for the diameters of the imaginary circles drawn from the center of the rotation axis of the impeller 1 and joining, respectively, the entrance and exit edges of the vanes 10 of the diffuser 2; $\alpha_3$, $\alpha_4$ denote, respectively, the entrance and exit angles of the vanes 10 of the diffuser 2; $\alpha =$ angle between the pitch line of the vane 10 of the diffuser 2 and the tangent line to an imaginary circle drawn from the center of the rotation axis of the impeller through any point on this pitch line (similar to angle $\beta$ in the impeller).

Table 2

| Diffuser version | $\Phi_0$ | $\psi_2$ | $D_4/D_3$ | $\alpha_3$ | $\alpha_4$ | $Z$ | $\frac{l}{\bar{A}}$ | $\alpha$ at $\frac{\tau_x-\tau_3}{\tau_4-\tau_3}=0{,}5$ |
|---|---|---|---|---|---|---|---|---|
| I | 0.08 | 0.68 | 1.48 | 22°24′ | 41°48′ | 16 | 5.2 | 23°02′ |
| II | 0.08 | 0.68 | 1.48 | 21°27′ | 36°27′ | 19 | 6.4 | 32°20′ |

Figure 8:
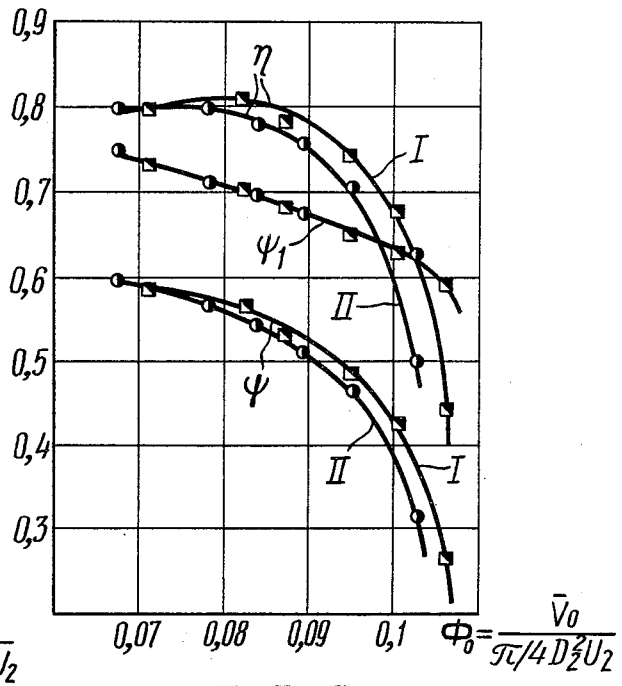
FIG. 8 shows the working characteristics of the stages of a radial centrifugal compressor with vaned diffusers.

Shown in FIG. 8 are the characteristics of the stages of a radial centrifugal compressor with vaned diffusers at $M_u = 0.78$ where figures I and II correspond to the versions of vaned diffusers in Table 2.

We can see in FIG. 8 that the vaned diffuser made according to the present invention increases the efficiency of a centrifugal compressor stage by 2–3% approximately compared with the vaned diffuser of a known design.

All the characteristics of the centrifugal compressor stages have been obtained at Mach numbers of 0.8 approximately. However, experimental tests have been conducted with the impellers and vaned diffusers at Mach numbers reching 0.92. This has not involved a noticeable reduction of efficiency of the centrifugal compressor stages with the impellers 1 and vaned diffusers 2 made according to the present invention.

Thus, the present invention increases the efficiency of a radial centrifugal compressor and widens the zone of its stable operation.

What is claimed is:

1. A centrifugal compressor comprising: an impeller; a diffuser installed concentrically with said impeller; blades equispaced around the circumference of said impeller and forming channels, the ratio of the length of each blade along its pitch line to the main arithmetical width of said blade channel being equal to 3.8 – 5.6 and said blade being shaped in such a manner that in the zone between the entrance edge of said blade and its center in the radial direction the angle between the pitch line in the longitudinal section of said blade and the tangent line to an imaginary circle drawn through any point of said pitch line from the center of the axis of rotation of said impeller is equal to the entrance angle of said blade while in the remaining zone of said blade this angle varies according to a quadratic parabola.

2. A centrifugal compressor according to claim 1 wherein the diffuser has vanes similar in shape to the impeller blades.

3. A centrifugal compressor according to claim 1 wherein the blades in each pair of adjacent impeller blades are of different length, their exit edges being located on an imaginary circle drawn from the center of the impeller axis of rotation while the diameter of an imaginary circle drawn from the center of the impeller axis of rotation and joining the entrance edges of the shorter blades is equal to 1.2 – 1.3 of the diameter of the imaginary circle drawn from the same center and joining the entrance edges of the other blades.

4. A centrifugal compressor according to claim 2 wherein the vanes in each pair of adjacent diffuser vanes are of different length, the exit edges of the vanes being located on an imaginary circle drawn from the center of the impeller axis of rotation while the diameter of an imaginary circle drawn from the center of the impeller axis of rotation and joining the entrance edges of the shorter vanes is equal to 1.2 – 1.3 of the diameter of the imaginary circle drawn from the same center and joining the entrance edges of the other vanes.

* * * * *